United States Patent [19]

Schneider

[11] Patent Number: 4,936,705

[45] Date of Patent: Jun. 26, 1990

[54] RESERVOIR FOR AN UNDERGROUND TANK

[75] Inventor: William A. Schneider, Conroe, Tex.

[73] Assignee: Owens-Corning Fiberglas Corporation, Toledo, Ohio

[21] Appl. No.: 169,519

[22] Filed: Mar. 17, 1988

[51] Int. Cl.[5] ..... B65G 5/00; G01M 3/04; G01M 3/26; G01M 3/32

[52] U.S. Cl. ..... 405/54; 73/49.2; 220/426; 220/428; 220/469

[58] Field of Search ..... 405/52–54; 73/49.2 T; 220/420, 426, 428, 469; 156/184, 187; 285/189, 423, 915

[56] References Cited

U.S. PATENT DOCUMENTS

| | | | |
|---|---|---|---|
| Re. 31,012 | 8/1982 | Allen | 285/114 |
| 3,848,765 | 11/1974 | Durkop | 73/49.2 T X |
| 4,110,947 | 9/1978 | Murray et al. | 405/54 X |
| 4,213,641 | 7/1980 | Bennett | 285/369 |
| 4,243,457 | 1/1981 | Mayumi et al. | 285/423 X |
| 4,329,193 | 5/1982 | Sznopek et al. | 156/162 |
| 4,504,086 | 3/1985 | Carrow | 156/187 X |
| 4,537,328 | 8/1985 | Keesee et al. | 220/420 X |
| 4,561,292 | 12/1985 | Pugnale et al. | 220/426 X |
| 4,685,327 | 8/1987 | Sharp | 73/49.2 T |
| 4,696,186 | 9/1987 | Sharp | 73/49.2 T |
| 4,708,015 | 11/1987 | Sharp | 73/49.2 T |

FOREIGN PATENT DOCUMENTS

| | | | |
|---|---|---|---|
| 1200619 | 9/1965 | Fed. Rep. of Germany | 73/49.2 T |
| 2352544 | 4/1975 | Fed. Rep. of Germany | 73/49.2 T |
| 211836 | 11/1984 | Japan | 73/49.2 T |
| 8002590 | 11/1980 | PCT Int'l Appl. | 285/137.1 |
| 428341 | 7/1967 | Switzerland | 73/49.2 T |

*Primary Examiner*—Randolph A. Reese
*Assistant Examiner*—John Ricci
*Attorney, Agent, or Firm*—Patrick P. Pacella; Charles R. Schaub

[57] ABSTRACT

A reservoir for leak detecting fluid for a tank is disclosed. A reservoir is used with a double wall glass fiber reinforced plastic tank where the tank has an inner wall, an outer wall, and annular space between the inner and outer walls for receiving a leak detecting fluid and an enclosed space within the inner wall for the storage of a liquid. An opening is provided in the outer wall of the tank and the opening is in communication with the annular space between the inner and outer walls. A one-piece reinforced plastic reservoir for leak detecting fluid is positioned on the tank. The reservoir has a sidewall and an end wall extending across one end of the sidewall. The sidewall is secured to the outer wall of the tank with the interior of the reservoir being in alignment with the opening in the outer wall of the tank. The sidewall is secured to the outer wall of the tank by a bead of glass fiber reinforced plastic that is positioned around the outer periphery of the sidewall and extends onto the outer wall of the tank to integrally bond the reservoir to the outer wall of the tank. The reservoir is positioned underground when the tank is installed underground. At least one fitting passes through the end wall of the reservoir. The fitting terminates in the interior of the reservoir and the fitting is secured to the end wall of the reservoir by a layer of glass fiber reinforced plastic that is positioned around the outer periphery of the fitting and extends onto the end wall to integrally bond the fitting to the reservoir.

10 Claims, 1 Drawing Sheet

RESERVOIR FOR AN UNDERGROUND TANK

BACKGROUND OF THE INVENTION

The invention relates to a double wall underground storage tank with leak-detecting means. More particularly the invention is directed to a double wall tank with a integral reservoir mounted on the tank for the leak-detecting liquid.

In double wall tanks there is an annular space between the two walls and leak detecting liquid is provided in this space. Loss of the leak detecting liquid occurs when a leak develops either in the inner wall or the outer wall of the tank. The space between the walls of prior underground tanks is connected, as by a pipe, to an above-ground reservoir having a liquid level monitoring device and usually an alarm system associated with the monitoring device. Upon development of a leak, the liquid level in the reservoir drops, the monitoring device senses a change in the liquid level and the monitoring device sets off the warning alarm. This type of system requires considerable plumbing to connect the annular space with the external reservoir for the leak detecting liquid. It is not unusual for leaks to develop in the plumbing connecting the annular space to the reservoir and this can result in a false indication that there is a leak in the tank. Since the external reservoir is located above ground, the liquid in the reservoir can be subjected to conditions not experienced by the leak detecting liquid in the annular space between the inner and outer wall of the tank. Freezing and extremely hot temperatures can produce conditions that can effect the operation of the leak detecting system so that the system does not function properly. All of the possible indicators of a false leak in the underground storage tank provides a great deal of difficulty for the owner of the tank. Usually material stored in the tank can have a detrimental effects if it leaks from the tank. Accordingly, the owners of the tank are required to very carefully monitor the condition of the tank and the level of the leak detecting liquid in an attempt to determine if in fact there is actually a leak in the tank. From some of the possible failures of the leak detecting system it can be extremely difficult to determine if the leak is in the plumbing for the leak detecting system or actually in the tank. Accordingly, it might be necessary to remove the material from the tank so that the tank can be dug up and replaced to prevent any chance that liquid is leaking from the tank.

Recently integral reservoirs for the leak detecting fluid have been mounted on the outer wall of the double wall tank. These reservoirs are formed by a manway type fitting that is secured to the outer wall of the double wall tank and this fitting is in alignment with a corresponding hole in the outer wall of the tank. The lower end of the manway type fitting terminates at the outer wall of the tank and communicates with the annular space between the two tank walls. A metal cover is secured by suitable means to the flange of the manway type fitting that is used to form the reservoir. The normal leak detecting device extends through the metal lid and into the reservoir. This is an improvement over the prior external reservoirs but there are still problems because of the metal lid, the connection of the metal lid with the flange of the manway type fitting and the connections between the metal lid and the leak monitoring equipment that passes through the metal lid. Since the reservoir is integral with the tank, the reservoir is below ground and there can be serious corrosion problems associated with the metal lids. It is also very difficult to prevent leaks between the metal lid and the leak monitoring equipment. Accordingly, there is still the potential that false indications of a leak in the tank can be generated by the leak monitoring equipment due to failures associated with the manway type reservoir.

Accordingly, there is a need for an improved reservoir that can be mounted integrally on the double wall storage tank where the reservoir and all of the connections are made of a non-corrosive material that is substantially the same as material used to form the tank. It is also desirable to have a one-piece reservoir to simplify the construction of the reservoir and minimize the connections where leaks can occur in the reservoir.

SUMMARY OF THE INVENTION

A reservoir for leak detecting fluid for a tank is disclosed. A reservoir is used with a double wall glass fiber reinforced plastic tank where the tank has an inner wall, an outer wall, and annular space between the inner and outer walls for receiving a leak detecting fluid and an enclosed space within the inner wall for the storage of a liquid. An opening is provided in the outer wall of the tank and the opening is in communication with the annular space between the inner and outer walls. A one-piece reinforced plastic reservoir for leak detecting fluid is positioned on the tank. The reservoir has a sidewall and an end wall extending across one end of the sidewall. The sidewall is secured to the outer wall of the tank with the interior of the reservoir being in alignment with the opening in the outer wall of the tank. The sidewall is secured to the outer wall of the tank by a bead of glass fiber reinforced plastic that is positioned around the outer periphery of the sidewall and extends onto the outer wall of the tank to integrally bond the reservoir to the outer wall of the tank. The reservoir is positioned underground when the tank is installed underground. At least one fitting passes through the end wall of the reservoir. The fitting terminates in the interior of the reservoir and the fitting is secured to the end wall of the reservoir by a layer of glass fiber reinforced plastic that is positioned around the outer periphery of the fitting and extends onto the end wall to integrally bond the fitting to the reservoir.

DESCRIPTION OF THE PREFERRED EMBODIMENTS

The invention relates to an integral reservoir for use in an underground storage tank. More particularly the invention is directed to a one-piece reservoir that is utilized with a double-wall underground storage tank. The features of the invention will be more readily understood by referring to the attached drawings in connection with following description.

Figure 1:
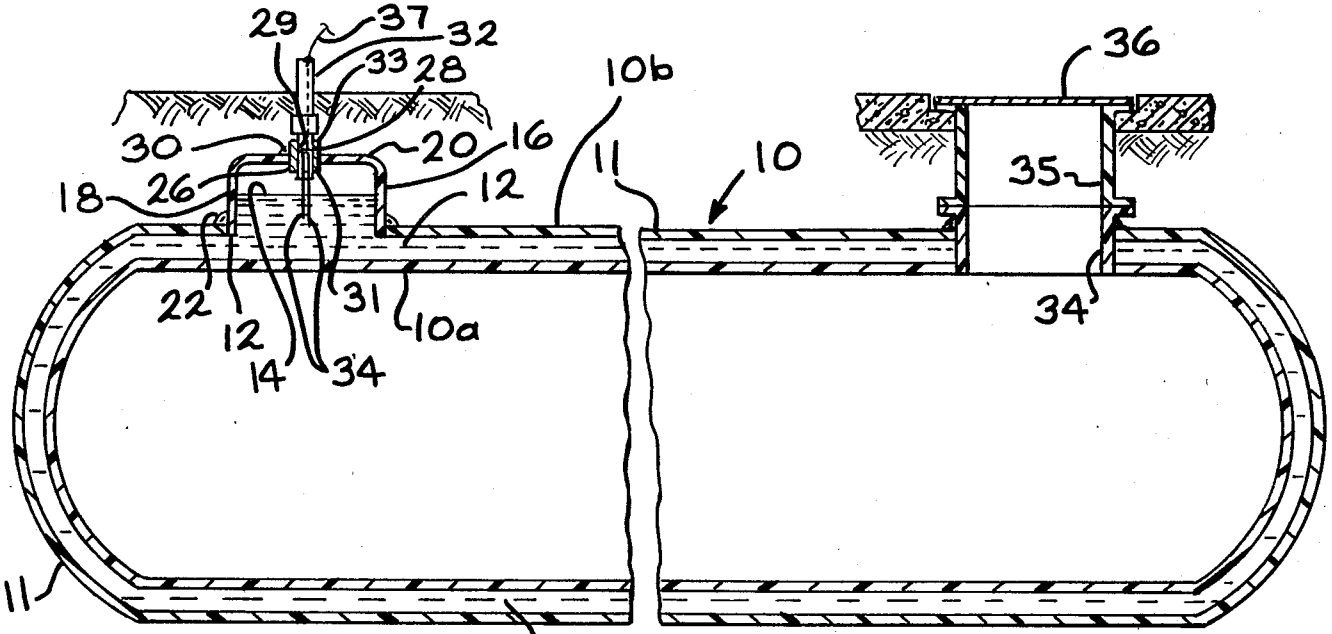
FIG. 1 is a fragmentary, longitudinal vertical sectional view of an underground double wall tank having an integral reservoir for leak detecting liquid in accordance with the invention.

In FIG. 1 there is shown a generally cylindrical double-wall underground tank 10. The tank 10 has an inner wall 10*a* and an outer wall 10*b*. An annular space 11 is located between the inner and outer walls. The tank 10 is preferably made of a non-corrosive glass fiber reinforced plastic and is provided with annular ribs (not shown) between the inner wall 10*a* and the outer wall 10*b*. An opening 12 is provided in the outer wall 10*b* of the tank 10. The opening 12 is normally substantially circular in shape and provides access to the annular space 11 between the inner wall 10*a* and the outer wall 10*b*.

A one-piece reservoir 16 is positioned on the outer wall 10*b* of the tank 10. The reservoir 16 has a sidewall 18 and an end wall 20 that closes one end of the sidewall. The end wall 20 is positioned substantially perpendicular to the sidewall 18. The end wall and sidewall form a chamber that is open on one end. The reservoir 16 is positioned on the tank 10 with the sidewall 18 being in contact with the outer wall 10*b* and the end wall 20 being spaced apart from the outer wall 10*b*. The sidewall 18 of the reservoir 16 is disposed to be substantially perpendicular to the longitudinal axis of the tank 10. The one-piece reservoir 16 is made of a glass fiber reinforced plastic material that can be substantially the same as the material utilized for the walls of the tank 10. The sidewall 18 has a shape that mates with the opening 12 in the outer wall 10*b* of the tank 10. As the opening 12 is usually circular, the sidewall 18 is also usually circular in shape. The end of the sidewall 18 that is spaced apart from the end wall 20 extend into the opening 12 defined in the outer wall 10*b* of the tank 10 so that the interior of the reservoir 16 is in communication with the annular space 11. The reservoir 16 is held in position on the tank by a bead 22 of glass fiber reinforced plastic that extends around the outer periphery of the sidewall and on the outer wall 10*b* of the tank 10. The bead 22 of fiberglas reinforced plastic effectively bonds reservoir 16 to the outer wall 10*b* of the tank 10. The bead 22 is usually a material that is substantially the same as the material utilized for the reservoir 16 in the walls of the tank 10. The bead 22 is usually placed on the reservoir 16 and outer wall 10*b* by a hand lay-up process where the glass fiber reinforced plastic material is applied when the reservoir is in the proper position on the tank. A bore 26 is provided in the end wall 20 of the reservoir 16. A fitting 28 is positioned in the bore and the fitting extends from each side of the end wall 20. The fitting 28 is held in position by a layer 30 of a glass fiber reinforced plastic material that extends around the outer periphery of the fitting 28 and on the end wall 20 of the reservoir 16. The layer 30 is also usually applied by a hand lay-up process when the fitting 28 is in the proper position in the bore 26. The layer 30 is usually formed of a material that is substantially the same as the material used for the walls of the tank 10 and the reservoir 16. A layer 30 of glass fiber reinforced plastic can be applied on the inner and outer surfaces of the end wall 20 to provide strength for fitting 28 and to integrally bond the fitting to the reservoir 16. The fitting 28 has a passageway 29 that extends through the center of the fitting. The passageway 29 can be threaded or otherwise constructed to connect other components, such as a pipe, to the reservoir 16. Usually the fitting is made of a non-corrosive plastic or glass fiber reinforced plastic material. Although only one fitting 28 has been shown, it should be understood that multiple fittings can be provided in the end wall 20 of the reservoir 16.

A pipe 32 is positioned in the passageway 29 of the fitting 28. The pipe 32 is constructed to mate with the securing means present in the passageway 29 of the fitting 28. A bead 33 of glass fiber reinforced plastic can also be positioned around the outer periphery of the pipe 32 and on the fitting 28 to integrally bond the pipe 32 to the reservoir. One end of the pipe 32 extends through the fitting 28 and into the interior of the reservoir 16. The other end of the pipe 32 extends from the reservoir to a point above the surface of the ground where the tank is buried. The pipe 32 is usually made of a non-corrosive plastic or glass fiber reinforced plastic material.

A leak detecting fluid 14 is positioned in the reservoir 16 and in the annular space 11 between the inner wall 10*a* and the outer wall 10*b* of the tank 10. The leak detecting fluid 14 is utilized to determine if there is a leak in either the inner wall 10*a* or the outer wall 10*b* of the tank 10. The pipe 32 provides access to the interior of the reservoir 16 so that the level of the leak detecting fluid 14 can be monitored. Periodically, a dip stick may be inserted down the pipe 32 to measure the level of the leak detecting fluid 14 to determine whether a leak has developed in either the inner wall 10*a* or the outer wall 10*b*. Alternatively, the probe 34 of a liquid level monitoring device 31 may be secured to the pipe 32 in such a manner as to project below the normal level of the leak detecting fluid 14 in the reservoir 16. The probe 34 or liquid level monitoring device 31 is then in a position to send a signal through appropriate electrical wires 37 positioned in the pipe 32 to an alarm device that is located above ground. Usually this signal is sent if the level of the leak detecting fluid drops below the end of the probe.

Because the reservoir 16 is positioned underground barely above the top of the tank 10, in most applications antifreeze is not required in the leak detecting fluid 14 and frequently water is use for this purpose. Since the reservoir is also positioned adjacent to the tank there is no need for a separate reservoir above ground and all the piping required to operatively connect such a remote reservoir to the annular space between the walls of the tank 10.

Access to the inside of the tank 10 is provided by a flanged manway fitting 34 communicating with the inside of the tank and a double-flanged extention 35 that is normally covered by a cover 36. The extention 35 is constructed so that the cover 36 is normally at approximately ground level.

The one-piece glass fiber reinforced plastic reservoir 16 eliminates the metal lid previously used on manway type reservoirs and the joint between the lid and the manway fitting. This greatly reduces the chance of leak in the reservoir as the joint and metal lid have been eliminated. Also the possibility of corrosion of the reservoir has been eliminated as the metal lid required on the manway type fitting has been eliminated. This is particularly significant as metal tanks have been replaced by glass fiber reinforced plastic tanks to eliminate corrosion related failures for the tanks. By replacing the metal lid utilized on a manway type reservoir this further reduces potential corrosion problems with the underground storage tank. The hand-laid up connection between the reservoir 16 and the fitting 28 forms a permanent bond that is also less subject to leaks than the prior metal fittings that were utilized with the metal lids of the prior manway fitting type reservoir. The use of a plastic or glass fiber reinforced fitting 28 and piping 32 connected to the fitting further reduces chance of developing corrosion related leaks in the reservoir 16.

Figure 2:
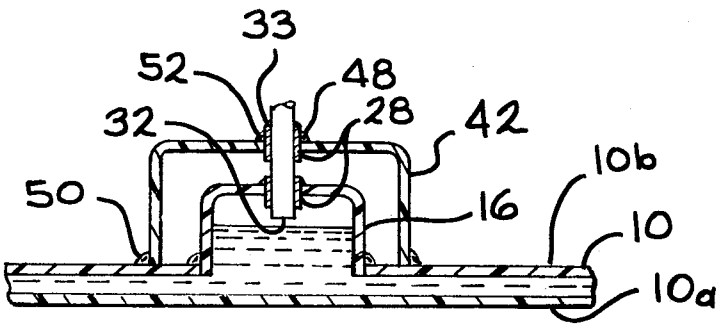
FIG. 2 is a fragmentary, longitudinally vertical sections view of an underground double wall tank having an alternative embodiment for the integral reservoir for leak detecting liquid.

FIG. 2 shows another embodiment of the invention where a one-piece sump 42 is positioned over the reservoir 16 on the outside of the tank 10. The sump 42 has a sidewall 44 and an end wall 46 positioned across one end of the sidewall. The sump 42 is positioned over the reservoir 16 and the end of the sidewall 44 that is spaced apart from the end wall 46 engages the outer wall **10*b* of the tank 10. A passageway 48 extends through the end wall 46 and the passageway is disposed to receive the pipe 32 that extends into the interior of the reservoir 16. A plastic or glass fiber reinforced fitting as previously discussed can be positioned in the passageway 48 for receiving the pipe 32. The sidewall 44 of the sump 42 is connected to the outer wall 10*b* by a bead 50 of fiberglas reinforced plastic material that is similar to the material utilized for the tank 10. A similar bead 52 can be positioned around the pipe 28 to securely fasten the pipe 28 to the sump 42. The bead 50 and the bead 52** can be applied in the manner previously discussed.

The sump 42 provides additional protection for the reservoir 16 and acts as a secondary containment chamber in the event that there is any damage to the reservoir 16. More particularly the sump 43 provides protection for the reservoir 16 from any damage due to handling of the tank especially when the ground is being backfilled around the tank after it has been positioned below grade.

Having described the invention in detail, it should be understood that such description is given only for the sake of explanation. Various modifications and substitutions, other than those cited, can be made without departing from the scope of the invention as defined by the following claims.

I claim:

1. An underground storage tank comprising:

a double wall glass fiber reinforced plastic tank, said tank having an inner wall, an outer wall, an annular space between said inner and outer walls for receiving leak detecting fluid and an enclosed space within said inner wall for storage of a fluid;

an opening in said outer wall of said tank, said opening being in communication with said annular space between said inner and outer walls;

a one-piece glass fiber reinforced plastic reservoir for leak detecting fluid positioned on said tank, said reservoir having a side wall forming an interior space of predetermined shape and an end wall integral with said sidewall and extending across one end of said side wall to enclose such interior space, the opposed and open end of said side wall being secured to said outer wall of said tank with said interior space being in alignment with said opening in said outer wall of said tank, said sidewall being secured to said outer wall of said tank by a bead of glass fiber reinforced plastic that is positioned around the outer periphery of said side wall and extends onto said outer wall of said tank to integrally bond said reservoir to said outer wall of said tank, said reservoir being positioned underground when said tank is installed underground;

at least one fitting positioned on and passing through said end wall of said reservoir, said fitting terminating in said interior space of said reservoir, said fitting being secured to said end wall of said reservoir by a layer of glass fiber reinforced plastic that is positioned around the outer periphery of said fitting and extends onto said end wall to integrally bond said fitting to said reservoir; and a pipe connected to said fitting, one end of said pipe extending into the interior of said reservoir and said end of said pipe extending above ground.

2. The reservoir of claim 1 wherein said sidewall of said reservoir has the same shape as said opening in said outer wall of said tank.

3. The reservoir of claim 2 wherein the end of said sidewall that is spaced apart from said end wall extends into said opening in said outer wall of said tank.

4. The reservoir of claim 3 wherein said bead and layer of glass fiber reinforced plastic is applied by a hand lay-up process where said glass fiber reinforced plastic is applied after said reservoir is positioned in said opening and said fitting is positioned in said passageway.

5. The reservoir of claim 1 wherein a one-piece glass fiber reinforced plastic sump having a side wall and an end wall extending across one end of said side wall is positioned over said reservoir, said end of said sump side wall that is spaced apart from said sump end well being secured to said outer wall of said tank, said pipe extending through said sump end wall, said sump providing protection for said reservoir and a secondary containment means to contain any leakage from said reservoir.

6. The reservoir of claim 5 wherein said sump is secured to said outer wall of said tank by a bead of glass fiber reinforced plastic that extends around the outer periphery of said sump and onto said outer wall of said tank, said bead integrally bonding said sump to said tank, said bead being applied by a hand lay-up process when said sump is properly positioned on said tank.

7. A reservoir for leak detecting fluid for an underground storage tank comprising:

a double wall glass fiber reinforced plastic tank, said tank having an inner wall, an outer wall, an annular space between said inner and outer walls for receiving said leak detecting fluid and an enclosed space within said inner wall for storage of a liquid;

an opening in said outer wall of said tank, said opening being in communication with said annular space between said inner and outer walls;

a one-piece glass fiber reinforced plastic reservoir for leak detecting fluid positioned on said tank, said reservoir having a sidewall and an end wall extending across one end of said sidewall, said sidewall having the same cross sectional shape as said opening in said outer wall of said tank, said end of said sidewall that is spaced apart from said end wall extending into said opening whereby the interior of said reservoir is in communication with said annular space between said inner and outer walls of said tank, said reservoir being secured to said outer wall by a bead of glass fiber reinforced plastic that is positioned by a hand lay-up process around said outer periphery of said sidewall and onto said outer wall of said tank to integrally bond said reservoir to said tank, said reservoir being positioned underground when said tank is installed underground;

at least one plastic fitting positioned on and passing through said end wall of said reservoir, said fitting terminating in said interior of said reservoir, said fitting being secured to said end wall of said reservoir by a layer of glass fiber reinforced plastic that is positioned by a hand lay-up process around the outer periphery of said fitting and extends onto said end wall to integrally bond said fitting to said reservoir, a passageway extending through said fitting and being in communication with said interior of said reservoir; and a plastic pipe positioned in said passageway of said fitting, said pipe being secured to said fitting in a liquid tight manner, one end of said pipe extending into said interior of said reservoir, said other end of said pipe extending above ground.

8. The reservoir of claim 7 wherein a one-piece glass fiber reinforced plastic sump having a sidewall and an end wall extending across one end of said sidewall is positioned over said reservoir, said end of said sump sidewall that is spaced apart from said sump end wall being secured to said outer wall of said tank by a bead of glass fiber reinforced plastic that is applied by a hand lay-up process around said outer periphery of said sump and onto said outer wall of said tank, said bead integrally bonding said sump to said tank, said sump providing protection for said reservoir and a secondary containment means to contain any leakage from said reservoir.

9. The reservoir of claim 8 wherein a plastic fitting is integrally bonded to said end wall of said sump by a layer of glass fiber reinforced plastic, said fitting being substantially in alignment with said fitting in said reservoir, said fitting in said sump having a passagewary for receiving said plastic pipe that extends from said fitting in said reservoir.

10. A reservoir for leak detecting fluid for an underground storage tank comprising:

a double wall glass fiber reinforced plastic tank, said tank having an inner wall, an outer wall, an annular space between said inner and outer walls for receiving said leak detecting fluid and an enclosed space within said inner wall for storage of a fluid;

an opening in said outer wall of said tank, said opening being in communication with said annular space between said inner and outer walls;

a one-piece glass fiber reinforced plastic reservoir for leak detecting fluid positioned on said tank, said reservoir having a sidewall and an end wall extending across one end of said sidewall, said sidewall being secured to said outer wall of said tank with said interior of said reservoir being in alignment with said opening in said outer wall of said tank, said sidewall being secured to said outer wall of said tank by a bead of glass fiber reinforced plastic that is positioned around the outer periphery of said sidewall and extends onto said outer wall of said tank to integrally bond said reservoir to said outer wall of said tank, said reservoir being positioned underground when said tank is installed underground;

at least one fitting positioned on and passing through said end wall of said reservoir, said fitting terminating in said interior of said reservoir, said fitting being secured to said end wall of said reservoir by a layer of glass fiber reinforced plastic that is positioned around the outer periphery of said fitting and extends onto said end wall to integrally bond said fitting to said reservoir; and a plastic pipe connected to said fitting, one end of said pipe extending into the interior of said reservoir and said other end of said pipe extending above ground, a leak detector means positioned in said pipe and extending into the interior of said reservoir.

* * * * *